United States Patent [19]

Richardson et al.

[11] 4,032,367

[45] June 28, 1977

[54] CORROSION RESISTANT STEELS

[75] Inventors: William Henry Richardson, Datchet; Prodyot Guha, High Wycombe, both of England

[73] Assignee: Langley Alloys Limited, Slough, England

[22] Filed: Oct. 8, 1976

[21] Appl. No.: 730,936

Related U.S. Application Data

[63] Continuation-in-part of Ser. No. 625,849, Oct. 28, 1975, abandoned.

[30] Foreign Application Priority Data

Oct. 28, 1974 United Kingdom ..... 46430/74

[52] U.S. Cl. ..... 148/38; 75/122; 75/125; 75/128 A; 75/128 B; 75/128 C; 75/128 N; 75/128 W; 148/37

[51] Int. Cl.[2] ..... C22C 38/42

[58] Field of Search ..... 75/122, 125, 128 A, 75/128 C, 128 N, 128 W; 148/37, 38

[56] References Cited

UNITED STATES PATENTS

| | | | |
|---|---|---|---|
| 3,567,434 | 3/1971 | Richardson et al. | 75/125 |
| 3,825,417 | 7/1974 | Costello et al. | 75/128 N |
| 3,854,937 | 12/1974 | Muta et al. | 75/128 W |
| 3,926,685 | 12/1975 | Gueussier et al. | 148/37 |

FOREIGN PATENTS OR APPLICATIONS

| | | | |
|---|---|---|---|
| 1,158,614 | 7/1969 | United Kingdom | 148/37 |

*Primary Examiner*—Arthur J. Steiner
*Attorney, Agent, or Firm*—Shoemaker and Mattare, Ltd.

[57] ABSTRACT

The invention provides a corrosion resistant high strength steel, which has a ferritic/austenitic microstructure consisting of 40 to 60% austenite grains embedded in a ferrite matrix being substantially free of precipitated particles of other phases, the steel consisting of the following elements in proportion by weight:

| | | |
|---|---|---|
| Chromium | 26.5% – 30% | by weight |
| Nickel | 7.4% – 14% | by weight |
| Molybdenum | 2.0% – 5% | by weight |
| Copper | 0.5% – 5% | by weight |
| Silicon | 0.2% – 2% | by weight |
| Manganese | 0.2% – 4% | by weight |
| Carbon | 0.01% – 0.1% | by weight |
| Nitrogen | 0.1% – 0.3% | by weight |
| Iron | Balance or remainder | |

1 Claim, 3 Drawing Figures

CORROSION RESISTANT STEELS

Figure 1:
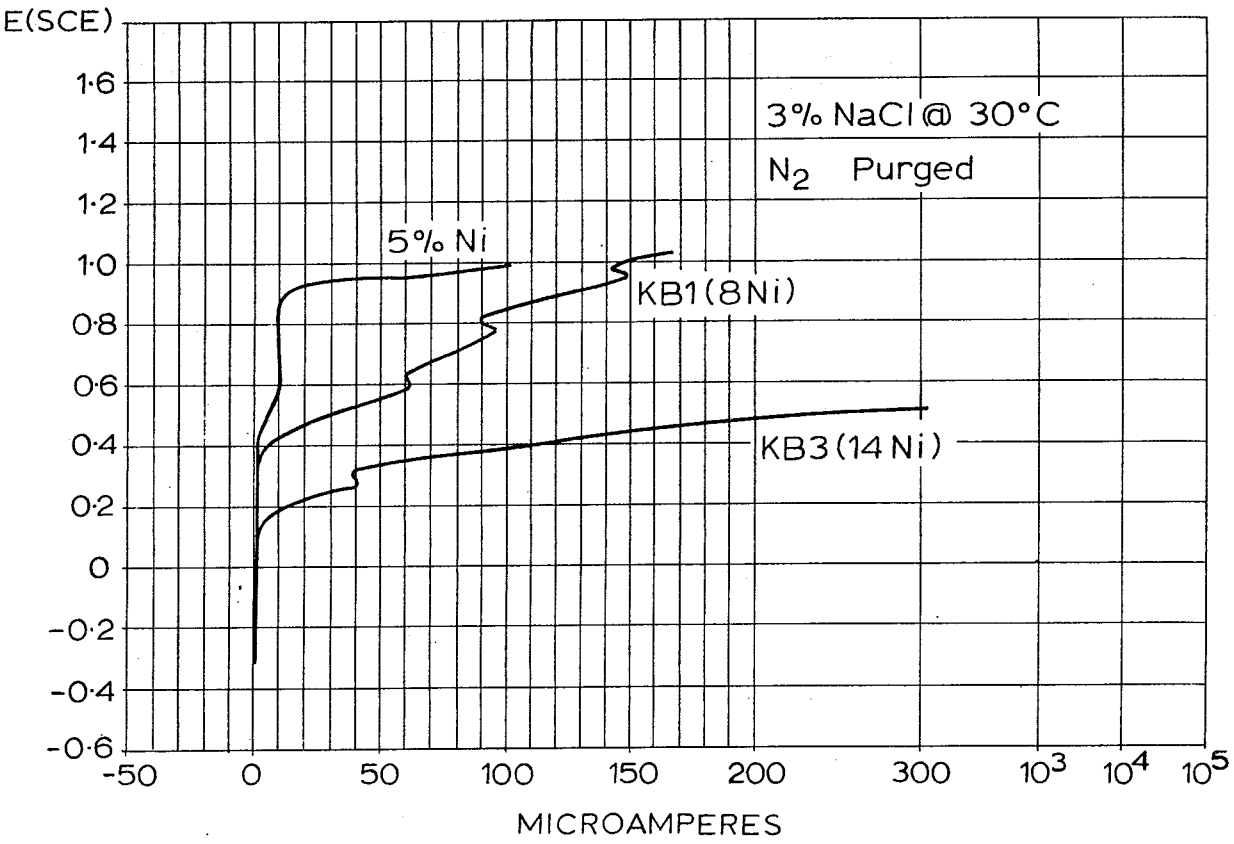

This application is a continuation-in-part of our earlier application Ser. No. 625,849 filed Oct. 28, 1975, now abandoned, and relates to corrosion resistant steels.

British patent specification No. 1,158,614 describes an austenitic/ferritic stainless steel of high strength and possessing an excellent resistance to corrosion in many environments, particularly sulphuric acid, phosphoric acid, sea-water and many other chloride containing substances. The steel defined in specification No. 1,158,614 included 23 to 30% chromium and 4 to 7% nickel.

However, it has now been established that the alloy there described may suffer corrosion in particularly severe conditions, particularly in high concentrations of sulphuric acid at elevated temperatures or in other similar non-oxidizing environments.

The object of this invention is to develop a stainless steel, particularly for production in the form of castings, which possesses an improved corrosion resistance in such non-oxidizing strongly acidic conditions, whilst maintaining the excellent corrosion resistance of the alloy described in British patent specification No. 1,158,614, to oxidizing conditions and to chloride containing environments.

By increasing the nickel content in excess of 7% (by weight), the maximum prescribed for the nickel content in the alloys described in British patent specification No. 1,158,614, improved resistance to corrosion in 70% sulphuric acid at 60° C is achieved. The effect of additions of more than 7% nickel is shown in Table I.

The composition of the alloys listed in Table I is given below in Table XII, and it will be seen that, apart from the nickel content, the other constituents of the alloy are present in generally similar proportions in each alloy example, and all examples contained less than 26% chromium.

TABLE I

| Alloy | 70% $H_2SO_4$ at 60° C % Nickel | Corrosion Rate |
|---|---|---|
| 40V | 5.18 | 550 mg/dm²day |
| KB 1 | 8.6 | 580 mg/dm²/day |
| KB 3 | 14.3 | 100 mg/dm²/day |
| KB 11 | 19.6 | 35 mg/dm²/day |
| KB 12 | 23.9 | 20 mg/dm²day |

It will be seen however that it was necessary to increase the nickel content very considerably above 7% in order to achieve an appreciable reduction in the rate of corrosion in this sulphuric acid environment.

However, increasing the nickel content beyond 7% resulted in an appreciable reduction in the resistance to pitting corrosion.

Resistance to pitting has been determined by potentiostatic testing techniques in which the method consists of the use of a cell in which the steel being studied is the electrode and the electrolyte is the medium in which corrosion is to be investigated. A typical electrolyte is 3% sodium chloride solution at a temperature of 30° C. The applied potential is progressively increased at a rate of 10 milli-volts per minute until the current density shows a rapid increase. This indicates a breakdown in the passive film which protects the steel against corrosion. The magnitude of the potential at which this breakdown of the passive film occurs is an indication of the resistance of the steel to pitting corrosion.

The results of tests carried out on an alloy 40V, according to British patent specification No. 1,158,614 and having about 5% nickel, compared with a similar alloy KB 1, with the nickel content increased to 8.6% and another similar alloy KB 3, with the nickel content increased to 14.3%, are shown in FIG. 1. The allows with higher nickel contents show a decrease in the potential at which corrosion commences.

An important characteristic of the alloys described in British patent specification No. 1,158,614 is the high mechanical strength combined with excellent ductility. Increasing the nickel content, to more than 7%, results in a second disadvantage namely progressive reduction in Proof Stress and Ultimate Tensile Strength and with the result that alloys containing 14 and 20% nickel are only marginally stronger than the austenitic stainless steels. Moreover, the higher nickel alloys do not respond to precipitation hardening.

These results are shown in Table II. Again, the composition of the alloys listed in Table II is shown in Table XII.

TABLE II

| Alloy | Condition | 0.5% Proof Stress T/sq.in. | Ultimate Tensile Strength T/sq.in. | % Elongation |
|---|---|---|---|---|
| 40 V | Annealed | 34.0 | 51.0 | 30.0 |
| | Annealed + aged | 42.0 | 62.0 | 25.0 |
| KB 1 | Annealed + aged | 36.8 | 54.9 | 29.0 |
| KB 3 | Annealed | 18.6 | 38.2 | 52.0 |
| | Annealed + aged | 17.7 | 36.4 | 52.5 |
| KB 11 | Annealed | 17.1 | 35.2 | 43.0 |
| | Annealed + aged | 16.1 | 33.6 | 38.0 |

Thus, from the above, and considering that the increase in the nickel content to above 7% (in an alloy otherwise as claimed in specification No. 1,158,614 but with less than 26% chromium), it is apparent that while there is an increased resistance to corrosion in a non-oxidizing environment, it is also the case that:

i. the increase in nickel has to be very substantial and possibly to as much as 14 to 20%;

ii. the resultant alloy has reduced resistance to pitting corrosion in a chloride environment; and iii. the resultant alloy is of reduced mechanical strength as compared with an alloy otherwise similar but with a nickel content of less than 7% by weight.

All the alloys, so far described, contain about 24 to 26% chromium.

It has now been found that by increasing the chromium content to at least 26.5%, the increase in nickel content necessary to give the required improvement in the resistance to corrosion in 70% sulphuric acid at 60° C is not so great and it will be seen from Tables III, VII, VIII and XI (see alloy E 21) that alloys containing a least 26.5% chromium require less than 14% nickel to achieve a negligible rate of corrosion. Moreover, as will be shown in Table V, and given that the chromium content is at least 26.5%, the nickel content may be as low as 7.4% whilst still retaining excellent mechanical properties.

TABLE III

| Alloy | 70% $H_2SO_4$ at 60° C % Chromium | % Nickel | Corrosion Rate |
|---|---|---|---|
| 40 V | 25.2 | 5.18 | 550 mg/dm²/day |

TABLE III-continued

| Alloy | 70% $H_2SO_4$ at 60° C % Chromium | % Nickel | Corrosion Rate |
|---|---|---|---|
| KB 27 | 28.2 | 7.8 | No loss |
| KB 28 | 27.5 | 9.2 | No loss |

Figure 2:
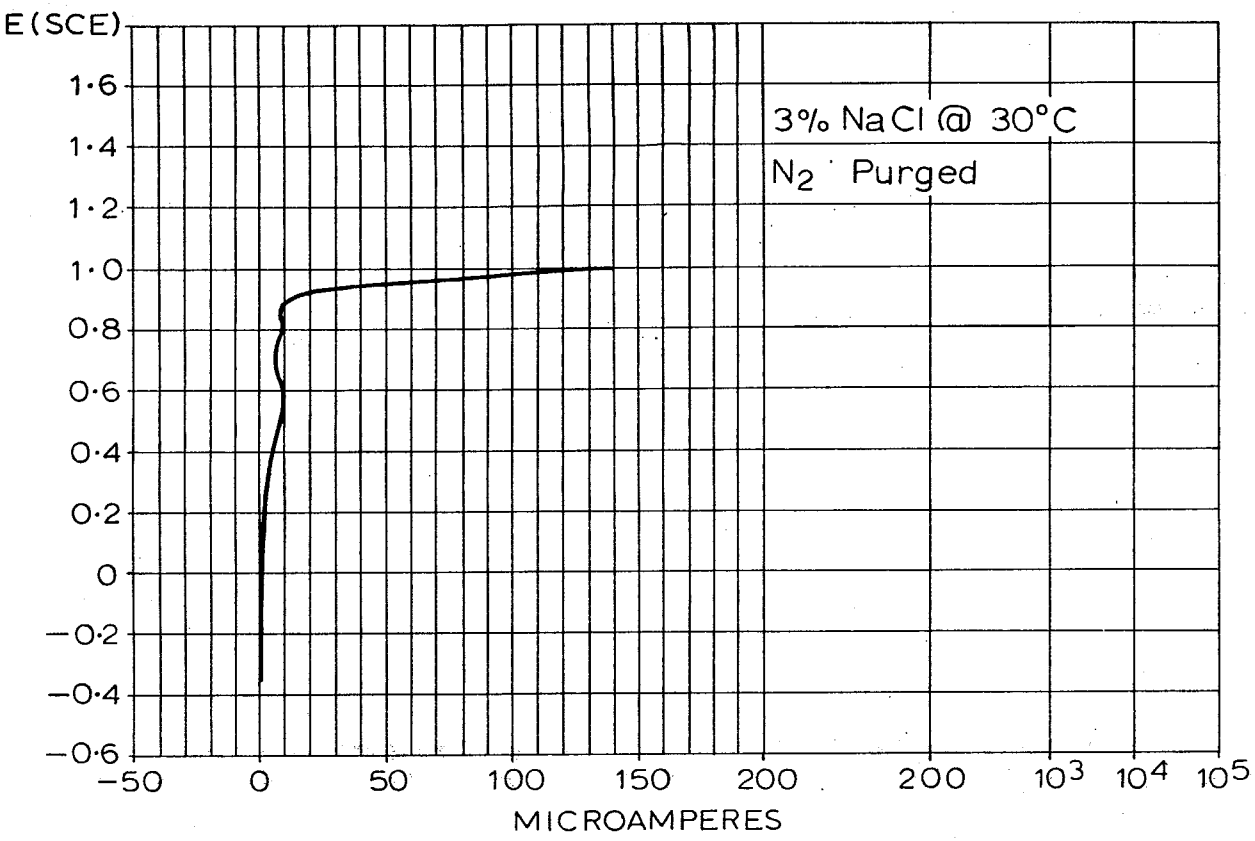

The pitting potential of these high chromium and high nickel alloys in a solution of 3% sodium chloride at 30° C has been determined and FIG. 2 shows a typical curve indicating the high pitting potential which is typical of these alloys.

The present invention, therefore, provides a highly corrosion resistant, high strength austenitic/ferrite steel consisting of:

| | | |
|---|---|---|
| Chromium | 26.5% – 30% | by weight |
| Nickel | 7.4% – 14% | by weight |
| Molybdenum | 2.0% – 5% | by weight |
| Copper | 0.5% – 5% | by weight |
| Silicon | 0.2% – 2% | by weight |
| Manganese | 0.2% – 4% | by weight |
| Carbon | 0.01% – 0.1% | by weight |
| Nitrogen | 0.1% – 0.3% | by weight |
| Iron | Balance or remainder | |

The steel according to the present invention has a ferritic/austenitic microstructure consisting of 40 to 60% austenite grains in a ferrite matrix, the microstructure being substantially free of precipitated particles of other phases.

With chromium contents of at least 26.5%, a reduction of the copper content can be made without loss of resistance to corrosion and if the copper content is maintained below about 3%, some problems in castings can be reduced.

A maximum of 30% chromium is a practical upper limit, as if this figure is exceeded, problems of brittleness and difficulty of casting are likely to occur, particularly if the nickel content is not correspondingly high also.

Excessive nickel is not justified on an economic basis in any case and a maximum of 14% is a practical upper limit for nickel, as if this figure is exceeded, the strength of the alloy may be undesirably reduced, particularly if the chromium content is not correspondingly high also.

In all the alloys according to the invention, nitrogen is present and this is considered of particular importance in these alloys with such a high content of chromium.

In order to arrive at a preferred range of composition, selected alloys were subjected to corrosion tests in 70% sulphuric acid at 80° C — the solution being purged with nitrogen during the test to ensure that the conditions were non-oxidizing. The results shown in Table IV indicate the good corrosion resistance of alloys according to this invention as compared with alloys having lower chromium and nickel contents than those now specified.

TABLE IV

| Alloy | 70% $H_2SO_4$ at 80° C % Chromium | % Nickel | Corrosion Rate |
|---|---|---|---|
| 40 V | 25.2 | 5.18 | 1700 mg/dm²day |
| KB 33 | 27.1 | 6.0 | 1500 " |
| KB 50 | 28.0 | 4.96 | 1600 " |
| KB 179 | 25.87 | 10.66 | 800 " |
| KB 28 | 27.5 | 9.2 | 650 " |
| KB 41 | 29.8 | 9.2 | 600 " |
| KB 42 | 28.9 | 10.8 | 550 " |
| KB 188 | 28.2 | 10.5 | 500 " |

TABLE IV-continued

| Alloy | 70% $H_2SO_4$ at 80° C % Chromium | % Nickel | Corrosion Rate |
|---|---|---|---|
| KB 186 | 29.2 | 10.3 | 500 " |
| KB 175 | 28.0 | 9.90 | 600 " |

It will also be noted from Table V that the increased chromium content of these high nickel alloys also results in an increase in strength as compared with the alloys and their properties listed in Table II, and these preferred alloys listed in Table V possess mechanical properties similar to those of the alloys according to British patent specification No. 1,158,614 and the alloys according to the invention also respond to precipitation hardening. This is achieved in the case of example KB 40, notwithstanding the nickel content is as low as 7.4%.

TABLE V

| Alloy | Condition | 0.5% Proof Stress T/sq.in. | Ultimate Tensile Strength T/sq.in. | % Elongation |
|---|---|---|---|---|
| 40 V | Annealed | 34.0 | 51.0 | 30.0 |
| | Annealed + aged | 42.0 | 62.0 | 25.0 |
| KB 27 | Annealed | 43.0 | 54.8 | 27.0 |
| | Annealed + aged | 49.0 | 66.5 | 24.0 |
| KB 28 | Annealed | 38.2 | 53.7 | 30.0 |
| | Annealed + aged | 39.9 | 62.5 | 27.0 |
| KB 40 | Annealed | | 58.9 | 24.0 |
| | Annealed + aged | 56.3 | 70.0 | 17.0 |
| KB 41 | Annealed | | 57.0 | 26.5 |
| | Annealed + aged | 50.0 | 67.2 | 24.0 |

The following Tables VI to X illustrate a further series of tests using the potentiostatic technique in order to determine the preferred range of composition for alloys according to the present invention.

In this technique, the test method consists of the use of an electrochemical cell in which the metal to be studied is the electrode and the medium in which we wish to study the interaction is the electrolyte. The potential for this interaction is measured by the use of a reference standard electrode. A saturated calomel electrode was used as standard for this series of experiments.

Electrolysis can be carried out with controlled potential and values of current density are plotted as a function of potential, the resultant potential-current relationship being known as the polarisation curve.

Figure 3:
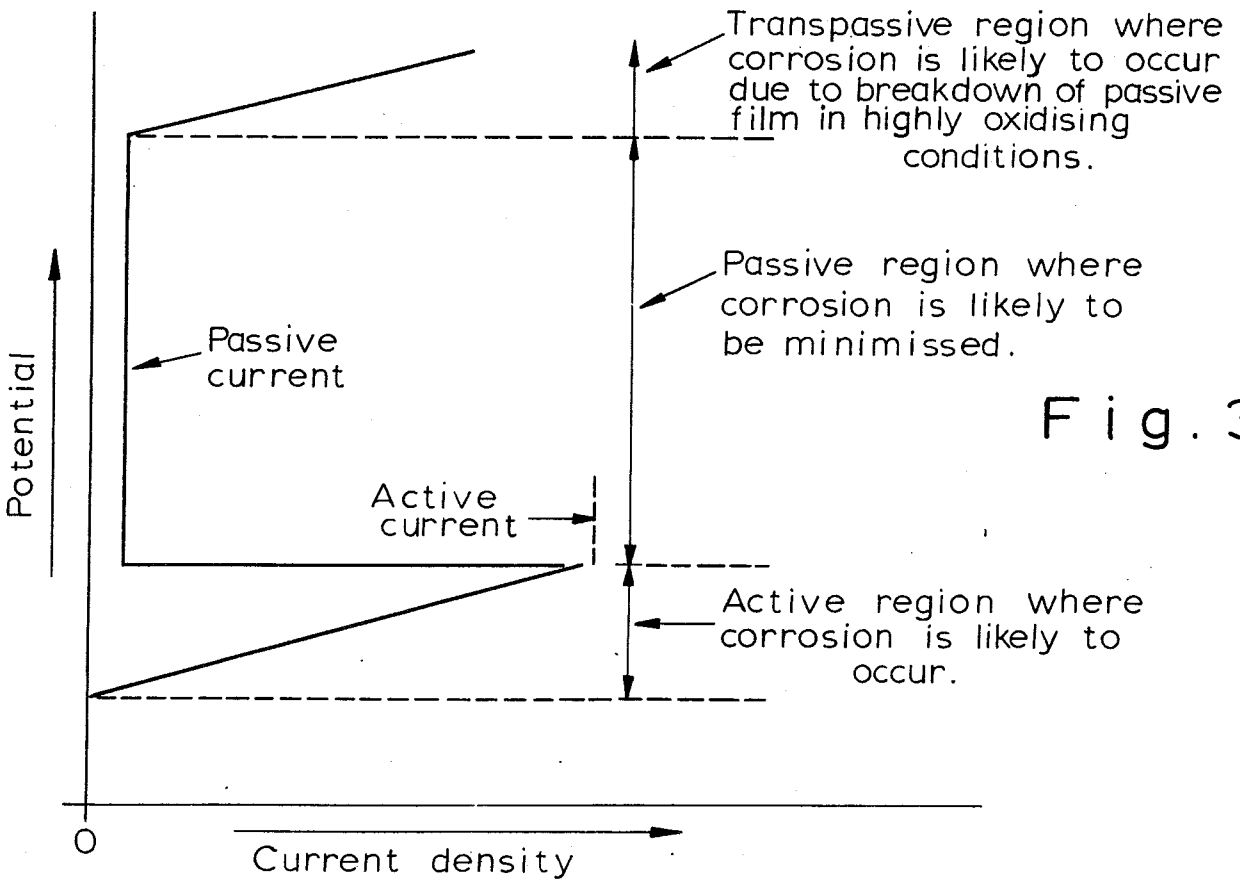

A typical polarization curve for stainless steels, where areas of corrosion and passivation are well defined, as shown in FIG. 3.

The current density is a measure of rate of corrosion both in the active and passive conditions.

In the series of experiments shown in Tables VI to X one set of samples were machined and then allowed to passivate in air for a minimum period of 1 week. Another set of samples were rendered active by imposing a negative potential giving rise to a negative or reducing current density of 1,000 $\mu$A for 30 seconds. This strongly reducing reaction destroys any oxide film that may have been formed on the sample and thus reducing the sample to its active state.

The series of experiments shown in Tables VI to X consisted of determining the active potential regions and active current densities by determining polarization curves. Activated and passivated samples were then immersed in the electrolyte and the free potential attained by the samples in a given electrolyte was monitored for a period of 20 hours. If the free potential attained is within the active region corrosion is likely to occur whereas if the free potential is above the active region passivation is likely which in turn will reduce corrosion rate by formation of a protective passive film.

The results of potentiostatic tests on active and passive samples shown in Table VII, VIII, IX and X clearly demonstrate that alloys according to this invention retain their passive condition or, alternatively, passivate more readily than 40V when the test is commenced on initially activated samples.

Experimental potentiostatic results were confirmed by conventional 7-day immersion tests, as shown in Table XI. In the last example of this test (Table XI) the specimen was surrounded by a neoprene O-ring to simulate a crevice formed at the surface of the sample.

TABLE VI 20-hour Potentiostatic Test Results
40% $H_2SO_4$ at 40° C Activated Samples

| Sample | Active Potential | Active Current Density | Initial Potential | Potential after 20 hours |
|---|---|---|---|---|
| 40V | −270 to −240 m.V. | 270 μA | −260 m.V. | −220 m.V. |
| E 7 | −250 to −200 m.V. | 80 μA | −270 m.V. | +160 m.V. |
| E 8 | −260 to −200 m.V. | 80 μA | −280 m.V. | +170 m.V. |

Weight Loss
40V - 0.03 gms. - sample slowly passivating.
E 7, E 8 - negligible weight loss - samples passivated readily.

TABLE VII

40% $H_2SO_4$ at 60° C Passivated Samples

| Sample | Active Potential | Active Current Density | Initial Potential | Potential after 20 hours |
|---|---|---|---|---|
| 40V | −380 to −250 m.V. | 1000 μA | −370 m.V. | −350 m.V. |
| E21 | −240 to −220 m.V. | 120 μA | − 60 m.V. | +220 m.V. |
| E22 | −240 to −220 m.V. | 110 μA | − 30 m.V. | +220 m.V. |
| E 7 | −250 to −220 m.V. | 130 μA | − 60 m.V. | 0 m.V. |
| E23 | −260 to −220 m.V. | 150 μA | − 10 m.V. | +260 m.V. |

Weight Loss
40V - 0.33 gms. - sample went active directly on immersion.
E21 - 0.005 gms. - passive film retained throughout test.
E22 - 0.0004 gms. - passive film retained throughout test.
E 7 - 0.0002 gms. - passive film retained throughout test.
E23 - Nil - passive film retained throughout test.

TABLE VIII

40% $H_2SO_4$ at 60° C Activated samples

| Sample | Active Potential | Active Current Density | Initial Potential | Potential after 20 hours |
|---|---|---|---|---|
| 40V | −380 to −250 m.V. | 1000 μA | −370 m.V. | −380 m.V. |
| E21 | −240 to −220 m.V. | 120 μA | −260 m.V. | −200 m.V. |
| E22 | −240 to −220 m.V. | 110 μA | −240 m.V. | −210 m.V. |
| E 7 | −250 to −220 m.V. | 130 μA | −240 m.V. | −200 m.V. |
| E23 | −260 to −220 m.V. | 150 μA | −250 m.V. | −210 m.V. |

Weight Loss
40V - 0.76 gms. - sample remained active throughout test.
E21 - 0.016 gms. - sample shows strong tendency to passivate.
E22 - 0.02 gms. - sample shows strong tendency to passivate.
E 7 - 0.016 gms. - sample shows strong tendency to passivate.
E23 - Nil - sample shows strong tendency to passivate.

TABLE IX

40% $H_2SO_4$ at 70° C Passivated samples

| Sample | Active Potential | Active Current Density | Initial Potential | Potential after 20 hours |
|---|---|---|---|---|
| 40V | −370 to −240 m.V. | 5000 μA | −370 m.V. | −370 m.V. |
| E18 | −240 to −200 m.V. | 400 μA | + 30 m.V. | +300 m.V. |
| E19 | −230 to −200 m.V. | 300 μA | − 40 m.V. | +160 m.V. |
| E20 | −220 to −200 m.V. | 175 μA | − 40 m.V. | + 60 m.V. |

Weight Loss
40V - 0.45 gms. - Sample went active directly on immersion.
E18 - 0.0004 gms. - Passive film retained throughout test.
E19 - 0.0002 gms. - Passive film retained throughout test.
E20 - 0.0001 gms. - Passive film retained throughout test.

TABLE X

40% $H_2SO_4$ at 70° C Activated samples

| Sample | Active Potential | Active Current Density | Initial Potential | Potential after 20 hours |
|---|---|---|---|---|
| 40V | −370 to −240 m.V. | 5000 μA | −330 m.V. | −340 m.V. |
| E18 | −240 to −200 m.V. | 400 μA | −240 m.V. | −200 m.V. |
| E19 | −230 to −200 m.V. | 300 μA | −230 m.V. | −200 m.V. |
| E20 | −220 to −200 m.V. | 175 μA | −220 m.V. | −200 m.V. |

Weight Loss
40V - Sample remained active and almost completely dissolved.
E18 - 0.08 gms. - Samples slowly passivating.
E19 - 0.03 gms. - Sample slowly passivating.
E20 - 0.03 gms. - Samples slowly passivating.

TABLE XI

IMMERSION TEST RESULTS
40% $H_2SO_4$ at 60° C

| Sample | Weight Loss |
|---|---|
| 40V | 1.5 gms. |
| E21 | No Corrosion |
| E22 | No Corrosion |
| E23 | No Corrosion |
| E 7 | No Corrosion |

40% $H_2SO_4$ at 70° C

| Sample | Weight Loss |
|---|---|
| 40V | 10.3 gms. |
| E18 | No Corrosion |
| E19 | Negligible Corrosion |
| E20 | No Corrosion |
| E23 | No Corrosion |

10% $FeCl_3$ at 30° C
(with neoprene 'O' ring crevice)

| Sample | Corrosion Rate |
|---|---|
| 40V | 1100 mg/dm²/day |
| KB197 | 63 mg/dm²/day |

TABLE XII

| Alloy | % Cr | % Ni | % Mo | % Cu | % C | % Si | % Mn | % $N_2$(nominal) |
|---|---|---|---|---|---|---|---|---|
| 40 V | 25.20 | 5.18 | 2.60 | 3.15 | .05 | 1.30 | 0.92 | 0.16 |
| KB 1 | 24.20 | 8.60 | 2.33 | 3.40 | .07 | 0.96 | 1.15 | |
| KB 3 | 24.60 | 14.30 | 2.33 | 3.29 | .07 | 0.97 | 1.30 | |
| KB 11 | 25.70 | 19.60 | 2.40 | 3.50 | .08 | 0.80 | 1.04 | |
| KB 12 | 24.80 | 23.90 | 2.33 | 3.18 | .06 | 0.84 | 1.08 | |
| KB 33 | 27.10 | 6.00 | 2.33 | 3.29 | .07 | IN- | 1.12 | |
| KB 50 | 28.00 | 4.96 | 2.60 | 3.22 | .05 | 0.96 | 1.26 | |
| KB179 | 25.87 | 10.66 | 2.60 | 3.20 | .06 | 0.87 | 1.12 | |
| *E 7 | 28.20 | 9.28 | 2.80 | 1.28 | .05 | 0.88 | 0.91 | |
| *E 8 | 27.30 | 12.20 | 2.69 | 1.25 | .05 | 0.94 | 0.80 | |
| *E 18 | 28.50 | 9.41 | 2.80 | 1.28 | .07 | 0.84 | 0.94 | |
| *E 19 | 28.40 | 9.12 | 3.81 | 1.24 | .07 | 0.96 | 0.90 | |
| *E 20 | 28.20 | 9.05 | 4.83 | 1.22 | .065 | 0.84 | 0.88 | |
| *E 21 | 26.50 | 9.33 | 2.84 | 1.27 | .07 | 0.82 | 0.98 | |
| *E 22 | 27.10 | 9.22 | 2.81 | 1.26 | .07 | 0.93 | 0.92 | |
| *E 23 | 28.50 | 9.07 | 2.76 | 1.24 | .06 | 0.87 | 0.87 | |
| *KB 27 | 28.20 | 7.80 | 2.20 | 3.05 | .06 | 0.85 | 1.27 | |
| *KB 28 | 27.50 | 9.20 | 2.07 | 2.95 | .06 | 0.91 | 1.21 | |
| *KB 40 | 29.60 | 7.40 | 2.50 | 3.22 | .06 | 0.88 | 1.36 | |
| *KB 41 | 29.80 | 9.20 | 2.60 | 3.50 | .07 | 1.59 | 1.09 | |
| *KB 42 | 28.90 | 10.80 | 2.60 | 3.20 | .06 | 1.38 | 1.38 | |
| *KB175 | 28.00 | 9.90 | 2.58 | 1.40 | .05 | 1.26 | 0.92 | |
| *KB186 | 29.20 | 10.30 | 2.46 | 3.20 | .06 | 0.79 | 0.92 | |
| *KB188 | 28.20 | 10.50 | 2.33 | 2.80 | .06 | 0.96 | 1.12 | |
| *KB197 | 28.20 | 8.47 | 2.46 | 2.80 | .07 | 0.96 | 0.83 | |
| | | | | | | 0.64 | | |

*According to the invention

We claim:

1. A corrosion resistant high strength steel, which has a ferritic/austenitic microstructure consisting of 40 to 60% austenite grains embedded in a ferrite matrix being substantially free of precipitated particles of other phases, the steel consisting of the following elements in proportion by weight:

| | | |
|---|---|---|
| Chromium | 26.5% - 30% | by weight |
| Nickel | 7.4% - 14% | by weight |
| Molybdenum | 2.0% - 5% | by weight |
| Copper | 0.5% - 5% | by weight |
| Silicon | 0.2% - 2% | by weight |
| Manganese | 0.2% - 4% | by weight |
| Carbon | 0.01% - 0.1% | by weight |
| Nitrogen | 0.1% - 0.3% | by weight |
| Iron | Balance or remainder | |

* * * * *